US006547221B1

(12) United States Patent
Bork et al.

(10) Patent No.: US 6,547,221 B1
(45) Date of Patent: Apr. 15, 2003

(54) KNOCK-DOWN GRIND RAIL FOR SKATEBOARDS AND ROLLERBLADES

(75) Inventors: Frank Bork, Bedford, PA (US); Frederick M. Rieber, Alum Bank, PA (US)

(73) Assignee: Hedstrom Corporation, Bedford, PA (US)

( * ) Notice: Subject to any disclaimer, the term of this patent is extended or adjusted under 35 U.S.C. 154(b) by 0 days.

(21) Appl. No.: 09/991,811

(22) Filed: Nov. 23, 2001

(51) Int. Cl.[7] ..... E04H 17/14

(52) U.S. Cl. ..... 256/65.01; 256/65.15; 403/378

(58) Field of Search ..... 403/378, 326, 403/286, 341, 292, 293, 294; 256/65.15, 59, 65.01, 65.02, 65.1, 65.14; 248/49; 292/339, 288

(56) References Cited

U.S. PATENT DOCUMENTS 3,127,870 A * 4/1964 Bieber ..... 256/65.15 X
4,557,467 A * 12/1985 Lin ..... 256/59
5,343,642 A * 9/1994 Magnusson ..... 403/292 X
2002/0050589 A1 * 5/2002 Nestel ..... 256/67

* cited by examiner

*Primary Examiner*—Lynne H. Browne
*Assistant Examiner*—John R. Cottingham
(74) *Attorney, Agent, or Firm*—Cesari and McKenna, LLP

(57) ABSTRACT

A knock-down grind rail for skateboards and rollerblades is composed of at least two tubes held in axial alignment by a tubular insert inserted into opposing ends of the tubes. The tubes are clamped together end to end by a special, generally U-shaped clip having arms which are bent toward one another to form elbows. The free ends of the clip are inserted through holes present in the tubes adjacent the opposing ends thereof, the spacing of the hole being comparable to the spacing of those arm ends. As the clip arms are pushed into the tubes up to the elbows, the arms are sprung apart thereby exerting a clamping force on the tubes. Suitable supports are provided to support the tube above the ground or other support surface.

12 Claims, 1 Drawing Sheet

KNOCK-DOWN GRIND RAIL FOR SKATEBOARDS AND ROLLERBLADES

BACKGROUND OF THE INVENTION

This invention relates to a grind rail for skateboards and rollerblades. It relates especially to a knock-down grind rail composed of butted tubular rail sections and to a quick release connection for such butted tubes.

A grind rail is a device or obstacle used by skateboarders to perform various acrobatic feats while on a skateboard. The grind rail consists of a relatively long, relatively large diameter rigid main tube or pipe which is supported by legs at an elevated location above the ground. To use the grind rail, a skateboarder accelerates along the ground toward one end of the grind rail and then leaps up so that the wheels of the skateboard engage the rail adjacent that end and roll along the rail. At any point along the rail, the rider may manipulate the board so that the wheels of the skateboard leave the rail allowing the skateboarder to descend to the ground. The skateboarder may perform various aerial maneuvers, e.g. a reversal flip, before reaching the ground. Rollerbladers also use grind rails.

To facilitate shipping and storing the grind rail, the grind rail may be sold in a knock-down condition. More specifically, the long main tube may be composed of two or more tube sections which are connected together end to end by the ultimate purchaser. Typically, the connection between the adjacent tube sections is made by telescoping the end of one section into the opposing end of the adjacent section and securing the overlapping segments of the two sections by threaded fasteners or the like. This type of connection is disadvantaged in that the edge of the outer tube constitutes a prominent discontinuity in the rolling surface of the grind rail. When the wheels of a skateboard or rollerblade roll over that edge annoying jolts or bumps are communicated to the rider.

Another problem with that type of connection is that the fasteners which are usually in the form of small screws which are screwed into preformed holes in the tube sections. These screws can become lost and their installation requires a tool such as a screwdriver which complicates the assembly of the grind rail. In addition, in some cases, the fasteners may be loosened due to vibrations imparted to the grind rail when in use. On the other hand, corrosion due to prolonged exposure to the weather may make it difficult to remove the fasteners in the event the grind rail has to be knocked down or disassembled for one reason or another. Still further, if the legs of the grind rail rest on uneven ground, the screw holes in the adjacent tube sections may not line up in the rotational direction necessitating the redrilling of the screw holes in at least one of the tube sections.

SUMMARY OF THE INVENTION

Accordingly, it is an object of this invention to provide an improved knock down grind rail for skateboards and rollerblades.

A further object of the invention is to provide a grind rail whose rail is composed of sections connected together end to end with no overlap.

Yet another object of the invention is to provide a grind rail of this type which can be assembled and disassembled without any tools.

An additional object of the present invention to provide an improved connection or coupling for connecting tubes together end to end.

Still another object of the invention is to provide a connection for butted tubes which can be made and unmade relatively easily.

Other objects will, in part, be obvious and will, in part, appear hereinafter. The invention accordingly comprises the features of the construction, combination of elements and arrangement of parts which will be exemplified in the following detailed description, and the scope of the invention will be indicated in the claims.

The present knock-down grind rail comprises a rigid main rail composed of a plurality of tube sections whose opposing ends are connected together in abutment. The main rail is supported above the ground by legs extending down from the tube sections.

The connection or coupling that connects the butted ends of the adjacent tubes includes a tubular insert which fits snugly within the opposing ends of the adjacent tubes, bridging the joint between the tubes. Each tube includes a hole for receiving an arm of a special, generally U-shaped clip which releasably couples the two tubes around the insert. The two arms of the clip are joined together outside the tube and are specially shaped so that when the clip is properly seated in the tubes, it draws the two tubes together end to end so that there is essentially no gap between them. Resultantly, the two coupled-together tubes present an essentially continuous cylindrical rolling surface for the wheels of skateboards and rollerblades.

Aside from the two tubes being joined, the connection comprises only two simple parts which are easy to manufacture in quantity. Furthermore, those parts may be assembled to create the connection without requiring any tools at all. Therefore, when the connection is incorporated into a grind rail, it does not add appreciably to the overall cost or complexity of the grind rail. Yet, the connection constitutes a definite marketing advantage because it enables the grind rail to be sold in a knock down condition for easy assembly by the purchaser. Also, while the invention is described in the context of a grind rail, it has equal application to other devices composed of tubes or pipes coupled together in abutment.

BRIEF DESCRIPTION OF THE DRAWING

For a fuller understanding of the nature and objects of the invention, reference should be made to the following detailed description taken in connection in the accompanying drawing, in which:

Referring to FIG. 1, the subject grind rail includes a horizontal main rail 10 composed of equal diameter rigid tubes 10*a* and 10*b* having their opposing ends butted together. The opposite or remote ends of the two tubes may be closed by end caps 11 plugged into those ends. Extending down from tube 10*a* adjacent to the opposite ends thereof is a pair of sockets 12. A similar socket 12 extends down from tube 10*b* adjacent to the end thereof remote from tube 10*a*. Rail 10 is supported at an elevated location above the ground by inverted T-shaped supports shown generally at 14. Each support includes a leg 14*a* having an end which plugs into the corresponding socket 12 and a cross arm 14*b*, also provided with end caps 11, and adapted to rest on the floor or ground G. Depending upon the lengths of tubes 10*a* and 10*b*, additional sockets 12 and supports 14 may be provided along the tubes in order to ensure the rigidity of rail 10. Also, a longer grind rail may include additional butted tube sections.

As shown in FIG. 2, the end segment of support leg 14*a* which plugs into socket 12 may be provided with several pairs of collinear holes 16 along its length which holes may be aligned with similar holes 18 in socket 12. By inserting a headed pin 22 through the appropriate pairs of aligned holes 16, 18, the rail 10 may be, while horizontal or inclined, set at different elevations above ground G. Preferably, pin 22 includes a hole 24 adjacent its tail end for receiving a locking clip 26 to retain the pin in place.

Desirably, the rail 10 is of steel tubing having a relatively large diameter in the order of 1.5 to 2.0 inches. The supports 14 are dimensioned to support rail 10 up to about 3.5 feet above the floor or ground. If necessary, the cross arms 14*b* of support 14 may be covered with non-slip covers or sleeves 28 on of which is shown on the leftmost support 14 in FIG. 1.

Figure 1:
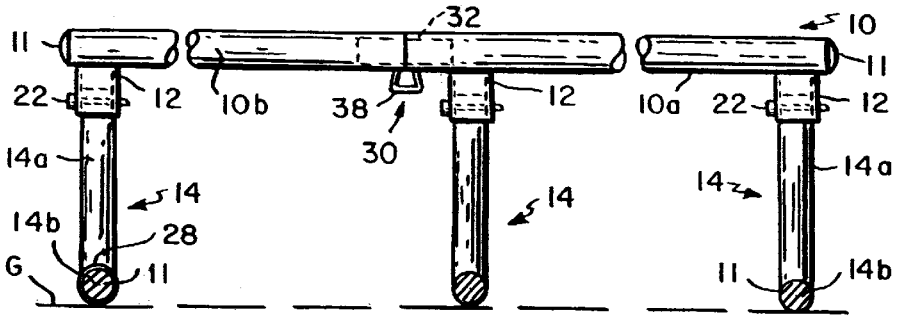
FIG. 1 is an elevational view of a grind rail comprising a pair of butting tubes and the connection between them.
Figure 2:
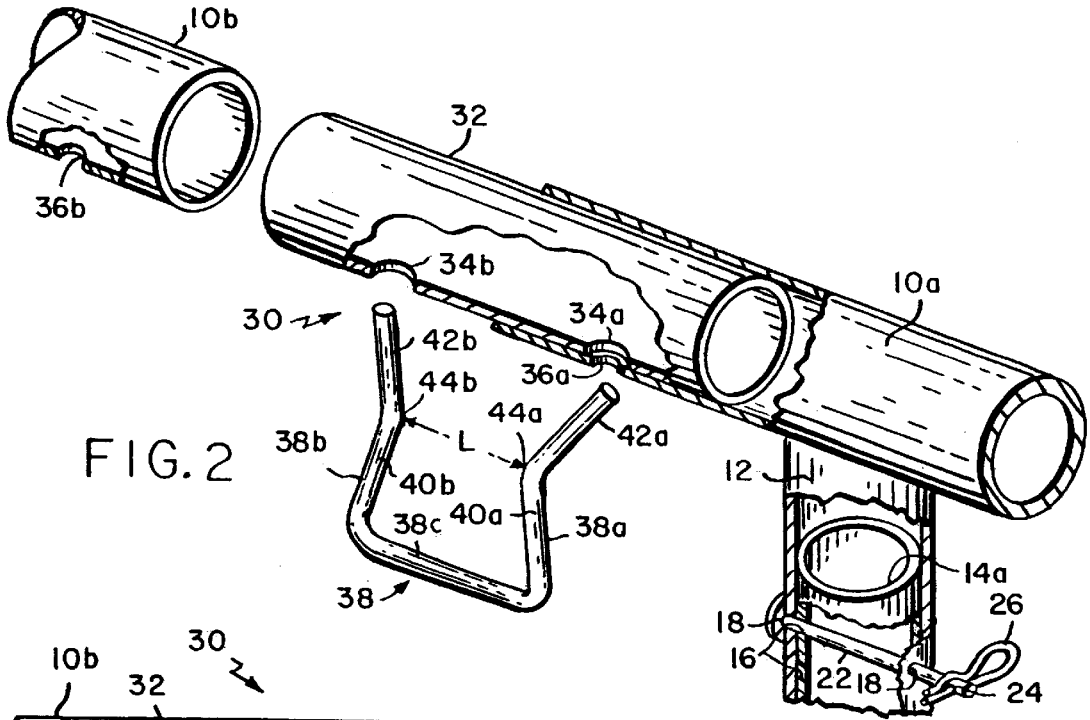
FIG. 2 is an exploded perspective view on a larger scale showing the components of the FIG. 1 grind rail in greater detail, the connection being in its unmade condition.

Referring now to FIGS. 1 and 2, the opposing ends of the two tubes 10*a* and 10*b* of rail 10 are joined by a connection or coupling shown generally at 30. Connection 30 includes a rigid tubular insert or liner 32 which fits snugly inside the opposing end segments of tubes 10*a* and 10*b*. The segment of insert 32 inside tube 10*a* is provided with a hole 34*a* which may be aligned with a hole 36*a* in the wall of tube 10*a*. Preferably, for reasons that will become apparent, the hole 34*a* is somewhat larger than the corresponding hole 36*a*.

Similarly, the segment of insert 32 inside tube 10*b* is provided with a relatively large hole 34*b* which, when the two tubes are butted together as shown in FIG. 1, is in alignment with a smaller hole 36*b* formed in the wall of tube 10*b*. Preferably, the tube holes 36*a*, 36*b* are a line with sockets 12 at the underside of rail 10.

Figure 3:
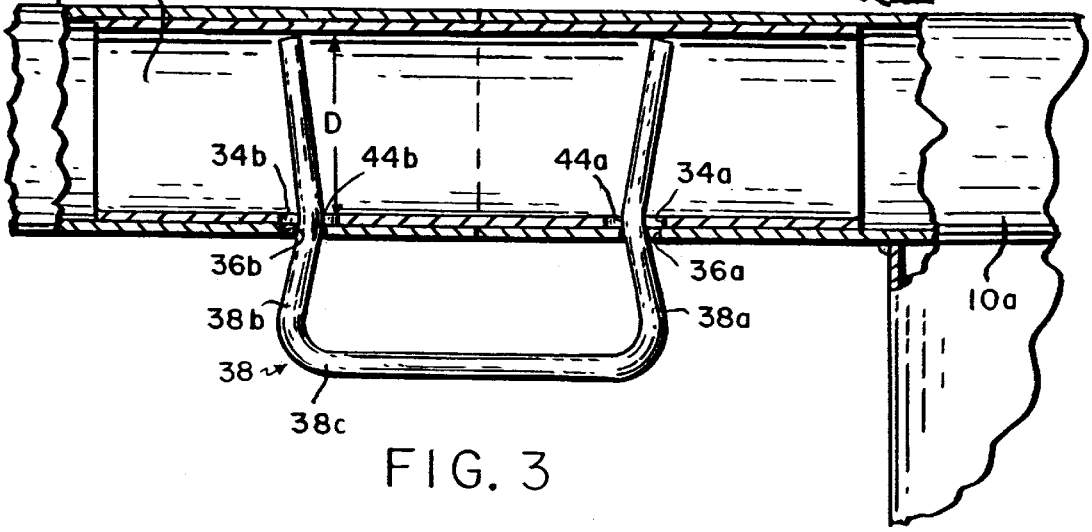
FIG. 3 is a fragmentary sectional view with parts in elevation illustrating the connection in its made condition.

Still referring to FIGS. 1 and 2, the remaining component of connection 30 is a generally U-shaped clip shown generally at 38. Preferably the clip is formed of relatively stiff wire, e.g., 0.185 inch diameter steel wire. Clip 38 has a pair of resilient mirror-image arms 38*a* and 38*b* joined at corresponding first ends by a bridging portion 38*c*, the opposite ends of those arms being free. As best seen in FIG. 2, arms 38*a* and 38*b* are formed with first segments 40*a*, 40*b* adjacent bridging portion 38*c* which toe in toward one another and second segments 42*a* and 42*b* which splay away from one another, forming elbows 44*a*, 44*b* more or less midway along the arms. These elbows define an imaginary line L of closest approach of the two arms. The dimensions of clip 38 are such that when tubes 10*a* and 10*b* are butted together with the insert holes 34*a*, 34*b* being in alignment with the tube holes 36*a*, 36*b*, respectively, the clip 38 may be received in those holes as shown in FIGS. 1 and 3 so as to firmly clamp the two tubes together end to end.

A complete understanding of the connection 30 requires a description at this point of the making of that connection. First the insert 32 is inserted into one of the tubes to be connected, e.g. tube 10*a*, so that one of the insert holes, e.g., hole 34*a*, is in alignment with the hole 36*a* in tube 10*a*. Then, one of the arms of clip 38, e.g., arm 38*a*, is inserted through the aligned holes 36*a*, 34*a*. Next, the other tube to be joined, i.e., tube 10*b*, is slid on to the exposed segment of insert 32 and adjusted relative to the insert so that the tube hole 36*b* is in general alignment with the other insert hole, i.e., hole 34*b*. Next, the other arm of clip 38, i.e., arm 38*b*, is inserted through the aligned holes 36*b* and 34*b*.

It should be emphasized that no flexing of the clip arms is required because the spacing of the free ends of the clip arms is greater than the distance between the two tube holes 36*a*, 36*b* when tubes 10*a* and 10*b* are in abutment. In other words, the tubes 10*a*, 10*b* can be spread apart axially as needed to enable the free end of the second-to-be-inserted clip arm 38*b* to pass through hole 36*b*. As noted previously, the sleeve holes 34*a* and 34*b* are oversized so that they allow such axial play of the tubes relative to the insert 32 so that the insert does not interfere with the insertion in the clip 38.

As clip 38 is pushed further into the tubes 10*a*, 10*b*, the arm segments 42*a* and 42*b* of clip 38 will engage the adjacent edges of tube holes 36*a* and 36*b* thereby drawing the two tubes together until they abut one another. Further seating of the clip beyond this point, causes arms 38*a*, 38*b* to be sprung apart so that the two tubes are clamped together end to end around insert 32 which holds the two tubes in perfect axial alignment. The clip 38 reaches its fully seated home position when the free ends of its arms 38*a*, 38*b* strike the tube walls opposite holes 36*a*, 36*b* causing an audible click which indicates that the connection has been made and that it is safe to use the grind rail.

Preferably, the length of the clip arms 38*a*, 38*b* is selected with relation to the diameter of tubes 10*a*, 10*b* such that when the clip is in its home position as shown in FIG. 3, the elbows 44*a*, 44*b* are located within the tubes so that as the clip approaches its home position, there is some relaxation of the clip arms. In other words, as shown in FIG. 3, the perpendicular distance D from the imaginary line defined by the second ends of the clip arms to each elbow 44*a*, 44*b* (and to line L) is less than the diameter of the tubes. This means that in order to remove the clip, an appreciable pulling force on the clip portion 38*a* will be required to spread apart the clip arms enough so that elbows 44*a*, 44*b* can pass out through the tube holes 36*a*, 36*b*. Thus, when seated, the clip 38 is in an over center position in rail 10 which tends to keep the clip in that position. Resultantly, there is little chance of the rail tubes 10*a*, 10*b* being disconnected inadvertently.

Also, while the connection 30 of the illustrated grind rail has a clip 38 both of whose arms penetrate the insert 32, it is also possible to spread the tube holes 36*a*, 36*b* farther apart and use a wider clip so that the clip legs 38*a*, 38*b* of the seated clip bracket the insert. The only requirement is that the seated clip 38 must prevent substantial axial movement of the insert relative to the tubes.

When the connection 30 is made as shown in FIG. 3, there is no discernable overlap or gap between the two adjacent ends of the two tubes 10*a* and 10*b*. Therefore, for all intents and purposes, rail 10 presents a smooth continuous surface to the wheels of skateboards and rollerblades.

Connection 30 is further advantaged in that while clamping together the two tubes 10*a* and 10*b* axially, because of the oversize insert holes 34*a*, 34*b*, the connection will allow a small amount of relative rotation of the two tubes to account for differences in the slope of ground G under the supports 14 at opposite ends of rail 10 and for small differences in the angular placement of the sockets 12 on those tubes.

It will be apparent from the foregoing that tube sections may be butted together and coupled by a connection consisting of, apart from the tubes themselves, only a tubular insert and a specially shaped clip which parts can be made and assembled quite easily to form a long continuous grind rail for skateboards and rollerblades.

In the event that it becomes necessary to disassemble the grind rail depicted in FIG. 1, that may be done simply by pulling down on clip portion 38*c* which will retract the clip from rail 10, the clip legs 38*a*, 38*b* flexing as necessary to permit their removal from the tube holes 36*a*, 36*b*. As soon as clip 38 is removed, the two tubes may be separated from insert 32. Also, the supports 14 may be separated from tubes 10*a*, 10*b* by removing the pins 22. Following such disassembly, the grind rail parts may be stored in a minimum amount of space.

It will thus be seen that the objects set forth above, among those made apparent from the preceding description, are efficiently attained. Also, certain changes may be made in the above construction without departing from the scope of the invention. For example, tube sections 10*a*, 10*b*, etc. may be connected together by connections 30 to form a railing, guard rail, gate or the like. Therefore, it is intended that all matter contained in the above description or shown in the accompanying drawing shall be interpreted as illustrative and not in a limiting sense. It is also to be understood that the following claims are intended to cover all of the generic and specific features of the invention described herein.

What is claimed is:

1. A grind rail for skateboards comprising a first tube having first and second ends and a wall extending therebetween;

a second tube having first and seconds ends and a wall extending therebetween, said first and second tubes having substantially the same diameter;

means defining a first hole in the wall of the first tube near the first end thereof;

means defining a second hole in the wall of the second tube near the first end thereof;

a tubular insert snugly received in said tube first ends so as to align said tubes axially with said first ends in close proximity, said tubes being oriented relatively so that said first and second holes are substantially aligned and spaced apart a predetermined distance, and a clip having resilient arms with corresponding first ends connected by a bridge and corresponding second ends which are free and spaced apart a distance at least as great as said predetermined distance, said arms being bent toward one another to form elbows intermediate said first and second ends, said elbows being spaced apart a distance appreciably less than said predetermined distance so that the second ends of the clip arms can be inserted easily into the first and second holes and the clip pushed into said tubes until the elbows are at or inside the tubes whereby the clip arms are flexed apart so as to clamp the first ends of the tubes together about the insert.

2. The grind rail defined in claim 1 and further including support means for supporting the second ends of the tubes above a support surface.

3. The grind rail defined in claim 2 wherein the support means comprise sockets extending from the first and second tubes substantially in line with a first and second holes therein, and legs having first ends interfitting with said sockets and second ends for engaging the support surface, said second ends having laterally extending portions extending perpendicular to the first and second tubes.

4. The grind rail defined in claim 3 and further including coacting height adjustment means in the sockets and the legs for adjusting the heights of the second ends of the tubes above the support surface.

5. The grind rail defined in claim 1 wherein the insert extends into the first and second tubes beyond the first and second holes therein;

the insert has additional holes aligned with the first and second holes, and the clip arms extend through said additional holes.

6. The grind rail defined in claim 5 wherein said additional holes are larger than the first and second holes.

7. The grind rail defined in claim 1 wherein the perpendicular distance from the imaginary line defined by the second ends of the clip arms to each elbow is less than the diameter of the tubes.

8. A grind rail for skate boards and in-line skates comprising a first tube having first and second ends and a wall extending therebetween;

a second tube having first and second ends and a wall extending therebetween, said first and second tubes having substantially the same outer diameter;

a first edge defining a first hole in the wall of the first tube near the first end thereof;

a second edge defining a second hole in the wall of the second tube near the first end thereof;

a tubular insert snugly received in said tube first end so as to align said tubes axially with said first and second ends in close proximity, said tubes being oriented relatively so that said first and second holes are substantially aligned and spaced apart a predetermined distance, and a clip having arms with corresponding first ends connected by a bridge and corresponding second ends which are free and spaced apart a distance at least as great as said predetermined distance, and biasing means acting between said clip and said insert for simultaneously urging said clip into said insert and urging the first ends of first and second tubes into abutment.

9. The grind rail defined in claim 8 wherein said biasing means include segments of said arms which have corresponding points of closest approach spaced from the second ends thereof which are themselves spaced apart a distance less than said predetermined distance so that when the clip arms are moved deeper into said first and second tubes, the clip arms engage said first and second edges and draw together the first ends of said tubes.

10. The grind rail defined in claim 8 wherein said biasing means include segments of said arms which toe in toward said bridge.

11. The grind rail defined in claim 8 wherein said insert extends into the first and second tubes beyond the first and second holes therein;

the insert has additional holes aligned with the first and the second holes, and the clip arms extend through said additional holes.

12. The grind rail defined in claim 11 wherein said additional holes are larger than the first and second holes.

* * * * *

UNITED STATES PATENT AND TRADEMARK OFFICE

CERTIFICATE OF CORRECTION

PATENT NO. : 6,547,221 B1
DATED : April 15, 2003
INVENTOR(S) : Frank Bork et al.

It is certified that error appears in the above-identified patent and that said Letters Patent is hereby corrected as shown below:

Column 5,
Line 59, change “a” to -- the --

Column 6,
Line 30, change “end” to -- ends --
Line 31, delete “and second”

Signed and Sealed this

Fifth Day of August, 2003

JAMES E. ROGAN
*Director of the United States Patent and Trademark Office*